US011596580B2

(12) United States Patent
Sun

(10) Patent No.: US 11,596,580 B2
(45) Date of Patent: Mar. 7, 2023

(54) NURSING BOTTLE HAVING AIR RETURNING FUNCTION

(71) Applicant: Qingyang Sun, Guangzhou (CN)

(72) Inventor: Qingyang Sun, Guangzhou (CN)

( * ) Notice: Subject to any disclaimer, the term of this patent is extended or adjusted under 35 U.S.C. 154(b) by 469 days.

(21) Appl. No.: 16/558,321

(22) Filed: Sep. 3, 2019

(65) Prior Publication Data

US 2020/0016040 A1 Jan. 16, 2020

Related U.S. Application Data

(63) Continuation-in-part of application No. 14/916,185, filed on Mar. 3, 2016, now abandoned.

(51) Int. Cl.
*A61J 9/04* (2006.01)

(52) U.S. Cl.
CPC ..... *A61J 9/04* (2013.01)

(58) Field of Classification Search
CPC ..... A61J 9/04
See application file for complete search history.

(56) References Cited

U.S. PATENT DOCUMENTS 7,537,128 B2 * 5/2009 Nachumi ..... A61J 9/006 215/11.5
8,899,449 B2 * 12/2014 Daansen ..... B05B 11/007 222/212
2008/0099422 A1 * 5/2008 Rees ..... A61J 11/02 215/11.5
2009/0014403 A1 * 1/2009 Lu ..... A61J 9/04 215/11.5

FOREIGN PATENT DOCUMENTS

KR 200360489 Y1 * 8/2004 ..... A61J 9/04

* cited by examiner

*Primary Examiner* — Tri M Mai
(74) *Attorney, Agent, or Firm* — Bayramoglu Law Offices LLC

(57) ABSTRACT

A nursing bottle having an air returning function comprises a bottle body, a fixing cover, a nipple, a ventilation component, an air conduit, an elastic one-way valve set at a second opening of the air conduit and is located at the interior of the air conduit, a mounting part located on the second opening of the air conduit to secure the elastic one-way valve. The ventilation component, the air conduit, the elastic one-way valve and the mounting part form a gas returning device and are located on the interior of the bottle. The bottle reduces the contacting area between the air and the milk, lowering the amount of vitamin loss. The phenomenon of vomiting milk, choking and flatulence will be omitted since no air bubble is generated.

13 Claims, 10 Drawing Sheets

NURSING BOTTLE HAVING AIR RETURNING FUNCTION

FIELD OF THE INVENTION

The present invention relates to the field of nursing bottles. More particularly, this invention relates to nursing bottles having an air returning function.

BACKGROUND OF THE INVENTION

The nursing bottles in the current market for feeding the babies generally have the following problems. A traditional nursing bottle is composed of a bottle body, a cap, and an elastic nipple. Except for the hole set on the elastic nipple, the other parts of the bottle are tightly sealed. When the baby sucks the milk, the volume of the liquid inside the bottle decreases and the air volume inside the bottle increases. A negative pressure is thus generated. The generated negative pressure increases a resistant force for the liquid flowing out from the elastic nipple. As a result, the baby has to suck quite strenuously under this circumstance. When a larger negative pressure is formed inside the bottle, the outside air is being pushed into the bottle, which can easily generate a large number of bubbles from the milk in the bottle. After sucking the milk containing gas bubbles, the gas accumulates inside the baby's abdomen, and the baby may spit up. Moreover, too much air in the stomach and digestive tract causes abdominal pain.

Generally, the vitamin C contained in milk has strong reducibility. It can be extremely easy to be oxidated and lost. While vitamin A has oxidability, when the content of vitamin C is reduced to a certain degree, vitamin A and vitamin E will start to be lost. When an outside air enters into the traditional bottle through holes of the elastic nipples, the contacting time between the outside air and the milk is long, which results in a significant decrease in vitamins A and E, or a complete loss of vitamin C.

In the market, there are also some bottles featured in preventing the phenomenon of flatulence. Those bottles are all set with an inner cap inside the bottle cap which compresses the nipple. There are several inlet holes on the inner cap. Air is transported into the bottom of the bottle through an air conduit. Air passes through the inlet hole and goes directly into the bottom of the bottle when the baby sucks the milk with the nursing bottle having above structure. This design can reduce air bubbles inside the milk, which prevents the flatulence from happening. However, due to the existence of the inlet holes, the milk will continue to drop into the baby's mouth even when the baby is not sucking the nipple (this is due to the generated positive pressure when feeding). The milk fills the baby's mouth, in this case, milk may flow out of the baby's mouth or the baby may spit up, which wets baby's clothes. More seriously, the milk naturally flows into the baby's esophagus and the trachea, which causes the phenomenon of choking on milk. Besides, since the pressures inside and outside the bottle are the same the milk could flow into the baby's mouth without sucking. This does harm to the training of baby's sucking ability.

In the case that the end of the air conduit extending into the bottle is not sealed and left open, milk can easily enter the air conduit, and thus cause milk leakage. Such kind of nursing bottle without a one-valve mounted on the end of the air conduit would make the liquid flow back to the air conduit when the nipple is pressed. The reversely flowed liquid would pass through the connecting and supporting components of the air conduit and finally flow out of the bottle. The reason of this phenomenon is that when the nipple is pressed down, the air inside the bottle is compressed, as the air conduit is configured to communicate with the outside atmosphere, the liquid inside the bottle subjected to the compression is forced to flow out of the bottle. In the practical use, the leakage of milk would definitely make the user feel awkward and troublesome, especially when going out, the leaked milk would stain the cloth of the baby. Moreover, this type of design often requires a conduit with a very small diameter, and it is hard to wash and clean the conduit without specific tools. Further, since the nursing bottle is held with the nipple down at a roughly 45 degrees angle when feeding a baby, the existing bottles (where the air conduit and its connecting and supporting components are configured to communicate with the outside atmosphere, the gravity of the liquid itself cannot be offset, so the liquid will keep flowing out to the mouth of the baby under the action of the gravity of the liquid) failing to offset the gravity of the milk can cause unexpected outflow of the milk even when the baby is not sucking, thereby causing choking to the baby. Choking to a baby can be a fatal risk, and there are many cases happening in day-to-day life that a baby gets choked due to the unexpected outflow of milk while the baby is not sucking the nipple. For the case that the end of the air conduit extending into the bottle is provided with a valve, usually, the valve holds the end of the conduit with its elasticity, which is easy to get loosened and detached. As a result, the valve will get lost easily, or even worse be eaten by the baby. Further, with this design, parents tend to disassemble the valve for washing and cleaning, which is likely to damage the valve and shorted the service life of the valve, making the one-way valve unable to open and close the air conduit normally with the natural elasticity of the valve. Since the valve is not fixed to the end of the air conduit, frequent disassembling will also cause damage to the air conduit. As the valve becomes loosened or damaged, milk will enter and block the air conduit, so a baby will have a hard time sucking the nipple against the negative pressure, causing a leakage. What's more, as the milk cannot flow out smoothly with the air conduit blocked, the overly resistant nipple could collapse, in this case the baby may swallow a large amount of air, causing flatulence and stomachache. Therefore, since the existing nursing bottles cannot completely address all the problems, there is a long-felt need to develop a nursing bottle which can avoid choking, spitting-up, nutrition loss etc. and has the advantage of easy packing and cleaning.

Besides, the air guiding device of the existing nursing bottle is complicated. There are many tiny accessories. The bottles must be cleaned and disinfected immediately after using, the cleaning time for the multiple parts is too long and it is quite inconvenient.

SUMMARY

The present invention is to provide a nursing bottle having an air returning function, which does not generate air bubbles in the milk, thus decreasing the phenomenon of spitting up milk, chocking, and flatulence. The manufacturing process is relatively simple, which is easy for the mass production. The simple structure is also easy to clean.

In order to achieve the above goals, the present invention provides the following solution: a nursing bottle having an air returning function, which comprises: a bottle body, a fixing cover, a nipple, wherein one end of the bottle body opens and the other end of the bottle body closes (i.e. is closed); the fixing cover is used to secure the nipple with the bottle body. The nursing bottle further comprises a ventilation component, which is configured to exchange air between an interior of the bottle body and an exterior of the bottle body; an air conduit, wherein the air conduit is an air vent device with two ends open, and the first opening of the air conduit is connected to the ventilation component; an elastic one-way valve set at a second opening of the air conduit and located in the interior of the air conduit, wherein the elastic one-way valve has at least one cut thereon; a mounting part is located on the second opening of the air conduit to secure the elastic one-way valve. The ventilation component, the air conduit, the elastic one-way valve and the mounting part forms a gas returning device and are located on the interior of the bottle.

Furthermore, the air conduit, the elastic one-way valve, and the mounting part are separately manufactured and connected to one another in a fixed manner, which means a user is unable to separate the air conduit, the elastic one-way valve, and the mounting part during normal use.

Furthermore, the air conduit, the elastic one-way valve, and the mounting part are molded as a single piece without a joint.

Furthermore, the air conduit and the mounting part are made of a solid material or an elastic material with a high rigidity, and the elastic one-way valve is made of an elastic material.

Furthermore, the nipple is provided with no hole for venting.

Furthermore, a back-up ring is located at the second opening of the air conduit. The back-up ring is used for the installation of the elastic one-way valve. The back-up ring and the air conduit are molded as a single piece without a joint.

Furthermore, an edge of the elastic one-way valve is connected between the back-up ring and the mounting part.

Furthermore, the mounting part is used to fix and keep a natural status of the elastic one-way-valve; the mounting part is firmly connected to the air conduit.

Furthermore, the ventilation component comprises a circular element having at least one bar passing through a center of the circular element and connecting two points on the circular element. The circular element is located at the opening of the bottle body. An air passage runs through the bar and the sidewall of the circular element at the two points along a length direction of the bar. At least two holes are formed on the circular element by the bar for passing liquid. The air passage is connected to the first opening of the air conduit. The air from the exterior of the bottle body successively passes through the air passage, the air conduit, and the elastic one-way valve to exchange air with the interior of the bottle body. The liquid inside the bottle body flows to the nipple through the holes formed on the circular element.

Furthermore, the air passage has an interference fit with the first opening of the air conduit.

Furthermore, each hole formed on the circular element is provided with a one-way valve, and the one-way valve is open when the nipple is being sucked under an external force, and the one-way valve is closed when the nipple is in the natural status.

Furthermore, the diameter of the circular element is no less than the diameter of the opening of the bottle body.

Furthermore, the ventilation component is a gas import hole, which is located on a side wall of the nipple. A supporting component is connected to the gas import hole. Supporting component is used to support and connect the first opening of the gas import hole. Inner air is exchanged with the exterior air in a sequence through the elastic one-way valve, the air conduit, the supporting component and the gas import hole. The gas import hole is provided with a valve to prevent foreign substances from entering the nursing bottle from the gas import hole. The valve may be a one-way elastic valve, etc.

Furthermore, the supporting component has an interference fit with the first opening of the air conduit.

Furthermore, a projection located in the middle of the nipple mouth is set with a milk hole.

Furthermore, the projection located in the middle of the nipple mouth comprises a nipple incision.

The present invention reduces the contacting area between the air and the milk, lowering the loss of vitamin. The baby would not spit up milk due to sucking into air. The flowing resistance of the milk is reduced. The baby can suck milk without using too much strength. When the baby is not sucking, the natural outflow of the milk from the nursing bottle is reduced to the greatest extent. Specifically, in the natural state, when the nursing bottle filled with milk is turned upside down for feeding, the milk will naturally flow out from the hole on the nipple under the effect of its own gravity. While, in the natural state, the one-way valve at the end of the air conduit is closed. After a small amount of milk has flowed out, a negative pressure inside the bottle is generated against the outside atmosphere (i.e. the air pressure inside the bottle is lower than that of the outside). The negative pressure will impair the effect of the gravity of the milk, so that the positive pressure is reduced to the greatest extent during the feeding, thereby automatically cutting off the flow of the liquid. When the baby applies a sucking force on the nipple, the sucking force is transmitted to the end of the air conduit to cause a one-way valve to open. The opening degree of the one-way valve varies as the sucking force of the baby varies. When the baby stops sucking or the sucking force is light, the one-way valve returns to the closed state to cutoff the access to the outside atmosphere. In this case, the negative pressure is generated again to offset the effect of the gravity of the milk, so as to automatically cut off the outflow of the milk. Therefore, according to the technical solution of the present invention, after filling the nursing bottle with liquid, the liquid will not flow out from the air conduit when the nipple is pressed because of the configuration of the one-way valve at the end of the air conduit. The reason is that even when the air inside the bottle is compressed, the air conduit is closed by the one-way valve, so the liquid cannot flow out of the bottle from the air conduit. In practical use, the nipple is only provided with the nipple incision for liquid outflowing, and no venting hole is provided on the nipple, so the user does not need to worry about milk leakage when going out. The milk flows out of the bottle only if the baby sucks the milk. The phenomenon of spitting, choking and flatulence will be omitted, since no air bubble is generated in the milk. The accessories for the bottle are greatly reduced, which brings in convenience for the daily use, cleaning, sterilizing and carrying. The risk for the baby's swallowing of small accessories is reduced. The manufacturing process is relatively simple, the mass production is thus easier to realize. To put it simply, it is important to ensure that the elastic one-way valve is configured with a natural state (i.e. no tension force applied on it), so it can open and close automatically, which can impair the effect of the gravity of the milk as the baby stops sucking or the sucking force is light and achieve a perfect balance between smooth milk outflow under sucking and anti-choking. If the elastic one-way valve is not configured with the natural state, it may not open and close normally, so the air passage would not work normally and the gravity of the liquid cannot be offset. As a result, the baby is likely to suffer choking or have a hard time getting the milk. The air returning assembly of the present invention can be used in a nursing bottle but not limited thereto. It can also be used in other drinking containers which need air returning and venting. The device can also be used in children's drinking cups, but not limited thereto.

BRIEF DESCRIPTION OF THE DRAWINGS

The following embodiments and the technical solutions are described in detail with the accompanying drawings. Brief descriptions of the figures are introduced as follows. Obviously, the accompanying drawings are only some specific embodiments of the present invention. People having ordinary skill in the art can obtain other figures according to the accompany figures without doing creative work.

The description of the labeled figures in the drawings.

Figure 1:
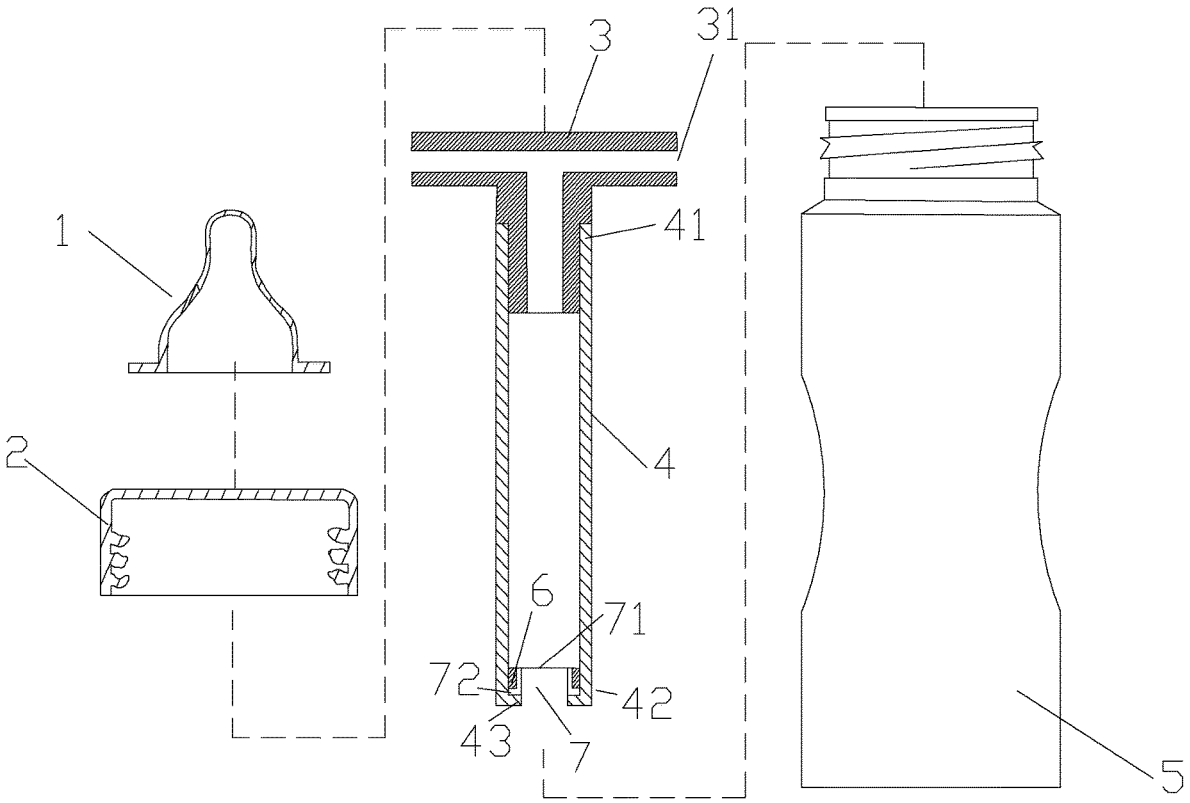
FIG. 1 is a diagrammatic cross-section view of the nursing bottle having air returning function in one embodiment of the invention.

1—nipple;
11—milk hole;
12—nipple incision;
13—supporting component;
14—gas import hole;
15—valve;
2—fixing cover;
3—circular element;
31—air passage;
32—milk channel;
33—one-way valve;
34—bar;
35—filter
4—air conduit;
41—first opening;
42—second opening;
43—back-up ring;
5—bottle body;
6—mounting part;
7—elastic one-way valve;
71—elastic one-way valve cut;
72—edges.

DETAILED DESCRIPTION OF THE INVENTION

The embodiments of the invention are described below to obtain a better understanding for one skilled in the art. This disclosure is not limited to the embodiments; any variations of the invention in the scope of the claims and within the spirit of the invention are obvious, and within the scope of protection of the invention.

A nursing bottle having an air returning function, which comprises: bottle body 5, fixing cover 2, nipple 1, wherein one end of bottle body 5 opens and the other end of the bottle body 5 closes; fixing cover 2 is used to secure and nipple 1 with bottle body 5.

The nursing bottle having an air returning function further comprises a ventilation component, wherein an interior of bottle body 5 exchanges air with an exterior of the bottle body through the ventilation component. In one preferred embodiment, circular element 3 or gas import hole 14 are used as the ventilation component. Circular element 3 or gas import hole 14 will be described below.

Air conduit 4 is an air vent device with two ends open. First opening 41 of air conduit 4 is connected to the ventilation component. In one preferred embodiment, air conduit 4 is a cylindrical pipe. The length of air conduit 4 should not be too long or too short, the length of air conduit 4 should be matched with bottle body 5. Preferably, the length of air conduit 4 should be a bit/little less than the length of bottle body 5. Preferably, the length of air conduit 4 is about 1 cm higher than the bottom of bottle body 5. Elastic one-way valve 7 is set at second opening 42 of air conduit 4 and located in the interior of air conduit 4, wherein elastic one-way valve 7 has at least one elastic one-way valve cut 71 thereon. The shape of elastic one-way valve cut 71 is not specifically restricted. The shape may comprise cross type, Y type, a horizontal shape or other types, and the shape is not limited thereto. Preferably, a part of elastic one-way valve 7 is located outside air conduit 4, and at least one elastic one-way valve cut 71 is provided on a sidewall of elastic one-way valve 7. The elastic one-way valve 7 is made of elastic materials such as silicon rubber, natural rubber, synthetic rubber and plastic body or other suitable elastic material.

Mounting part 6 is located on second opening 42 of the air conduit 4 to fasten elastic one-way valve 7. In one preferred embodiment, mounting part 6 is located inside air conduit 4. Mounting part 6 and air conduit 4 are interference fit with each other. Air conduit 4, elastic one-way valve 7, and the mounting part 6 are connected to one another in a fixed manner. Alternatively, air conduit 4, elastic one-way valve 7, and the mounting part 6 are molded as a single piece without a joint. Unless damaged, elastic one-way valve 7 cannot be taken out from air conduit 4 even under exogenous forces. The ventilation component, the air conduit 4, elastic one-way valve 7 and mounting part 6 forms a gas returning device and are located on the interior of bottle body 5. Air conduit 4 and mounting part 6 are made of solid material such as polypropylene (PP), polyphenylene sulfone resins (PPSU), silicone, etc.

Figure 2A:
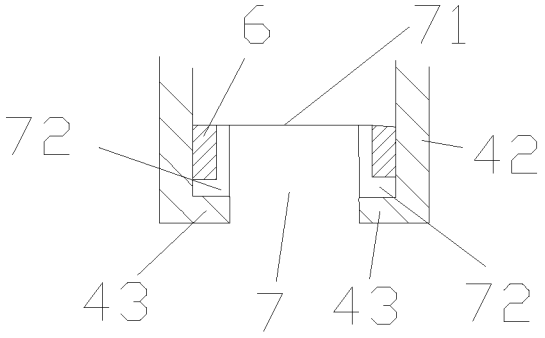
FIG. 2A is a cross-sectional view showing that the elastic one-way valve, the air conduit, and the mounting part being connected to one another in a fixed manner according to one embodiment of the invention.
Figure 2B:
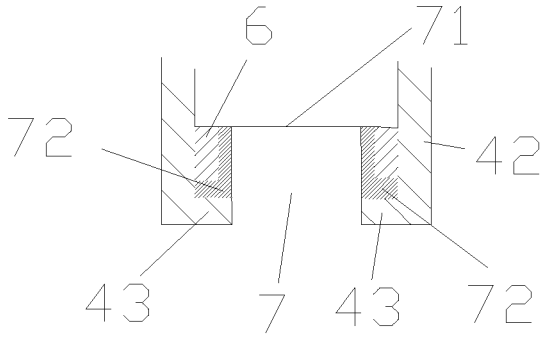
FIG. 2B is a cross-sectional view showing that the elastic one-way valve, the air conduit, and the mounting part are molded as a single piece without a joint according to another embodiment of the invention.
Figure 2C:
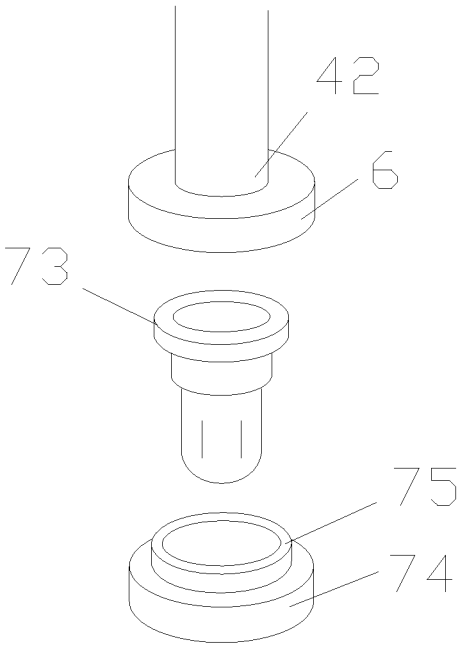
FIG. 2C is an exploded view showing the mounting part, the elastic one-way valve, and the fixing member.
Figure 2D:
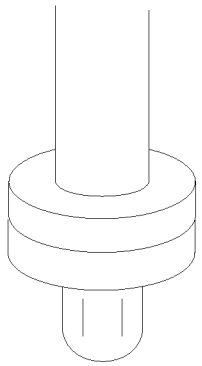
FIG. 2D is a diagram showing the normal state of the elements in FIG. 2C.
Figure 3:
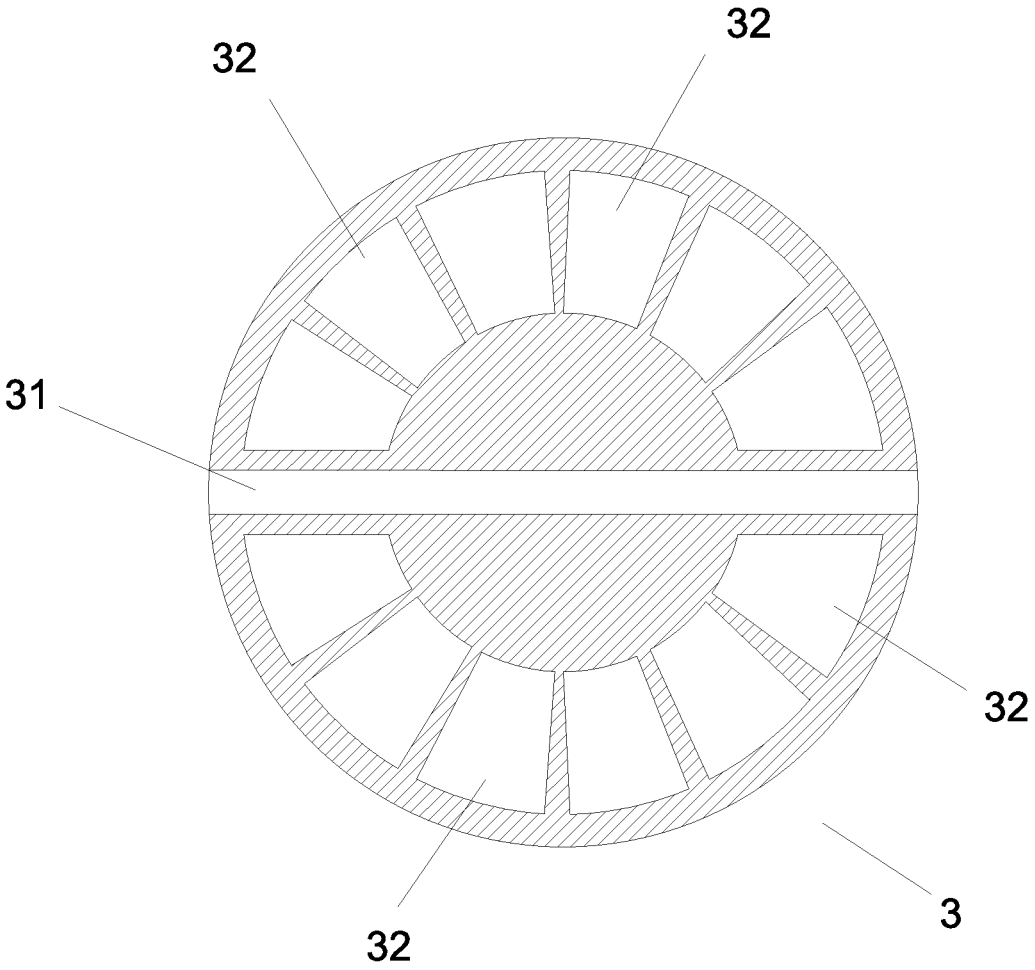
FIG. 3 is a cross-sectional view of the circular element according to one embodiment of the invention showing the holes formed on the circular element.

Alternatively, as shown in FIGS. 2C and 2D, the mounting part 6 maybe integrally molded on the outer edge of the second opening 42 of the air conduit 4 to form a single piece without joint. Connection part 73 of elastic one-way valve 7 is sandwiched between the mounting part 6 and fixing member 74 to be fixed and secured. Further, the fixing member 74 matches with the shape of elastic one-way valve 7 and has inner protrusion edge 75 to tightly fasten connection part 73 of elastic one-way valve 7 against mounting part 6. Moreover, the outer edge of fixing member 74 is fixedly connected to the outer edge of mounting part 6 so unless the connection between mounting part 6 and fixing member 74 is damaged, elastic one-way valve 7 cannot be separated from air conduit 4 even under strong external forces. FIGS. 2C and 2D show an example of the structure, and the present invention, however, is not limited thereto.

In a preferred embodiment, the ventilation component is circular element 3. Circular element 3 is located on an opening of bottle body 5. Air passage 31 and milk channels 32 are located on circular element 3.

In a preferred embodiment, back-up ring 43 is located at the second opening of air conduit 4. Back-up ring 43 is used for the installation of elastic one-way valve 7. Back-up ring 43 and air conduit 4 are molded as a single piece without a joint.

In a preferred embodiment, an edge of elastic one-way valve 7 is connected between back-up ring 43 and mounting part 6. Mounting part 6 is also connected to the edge of elastic one-way valve 7 to keep a natural status of elastic one-way-valve 7. In the case that air conduit 4, elastic one-way valve 7, and the mounting part 6 are connected to one another in a fixed manner, the edge of elastic one-way valve 7 is tightly placed between back-up ring 43 of air conduit 4 and mounting part 6, and back-up ring 43 and mounting part 6 are fixedly connected by a strong glue, or any other means that can make the user unable to separate them.

In a preferred embodiment, the ventilation component is circular element 3 having at least one bar 34 passing through a center of circular element 3 and connecting two points on circular element 3. Circular element 3 is located on the opening of bottle body 5. Air passage 31 runs through bar 34 and the sidewall of circular element 3 at the two points along a length direction of bar 34. At least two holes 32 are formed on circular element 3 by bar 34 for passing liquid. Air passage 31 is connected with first opening 41 of air conduit 4. The air from the exterior of bottle body 5 successively passes through the air passage 31, air conduit 4, and elastic one-way valve 7 to exchange air with the interior of bottle body 5. The liquid in the interior of bottle body flows into nipple 1 through holes 32 formed on circular element 3. Air passage 31 is connected to the first opening 41 of air conduit 4.

In one preferred embodiment, air passage 31 has an interference fit with first opening 41 of air conduit 4. This structure ensures a close contact between air passage 31 and the air conduit 4. Air passage 31 and air conduit 4 cannot separate from each other under natural conditions if there is no external force.

In one preferred embodiment, the diameter of circular element 3 is greater than or equal to the diameter of the opening of the bottle body 5, which guarantees that circular element 3 will not fall into the inner chamber of bottle body 5.

In one preferred embodiment, as is described in FIGS. 2A-2D. The milk inside bottle body 5 flows into nipple 1 through holes 32. At the same time, referring to FIGS. 4A and 4B, the holes 32 are each provided with one-way valve 33 or a filter 35, or both one-way valve 33 and filter 35, when there is an external force for sucking nipple 1, one-way valve 33 opens. Correspondingly, when nipple 1 is under normal condition, one-way valve 33 closes. One-way valve 33 may be an elastic membrane made of silicone, rubber, or other similar elastic materials, and one-way valve 33 is provided with at least one cut thereon. One-way valve 33 may also be other elements that can achieve the purpose of a one-way valve.

In one preferred embodiment, the ventilation component is gas import hole 14. Gas import hole 14 is located at the side wall of nipple 1. The gas import hole 14 is connected with supporting component 13. Supporting component 13 is connected with first opening 41 of air conduit 4. The air in the inner ambiance passes through elastic one-way valve 7, air conduit 4, supporting component 13, gas import hole 14 and bottle body 5 in turn to exchange with the exterior air of bottle body 5. The gas import hole 14 is provided with the valve 15 to prevent foreign substances from entering the nursing bottle from the gas import hole 14. The valve 15 may be a one-way elastic valve, etc.

In one preferred embodiment, supporting component 13 has an interference fit with first opening 41 of air conduit 4. That is, when there is no external force, supporting component 13 will not separate from air conduit 4. Supporting component 13 and air conduit 4 can be separated from each other under external force to clean supporting component 13 and air conduit 4 separately.

Figure 4A:
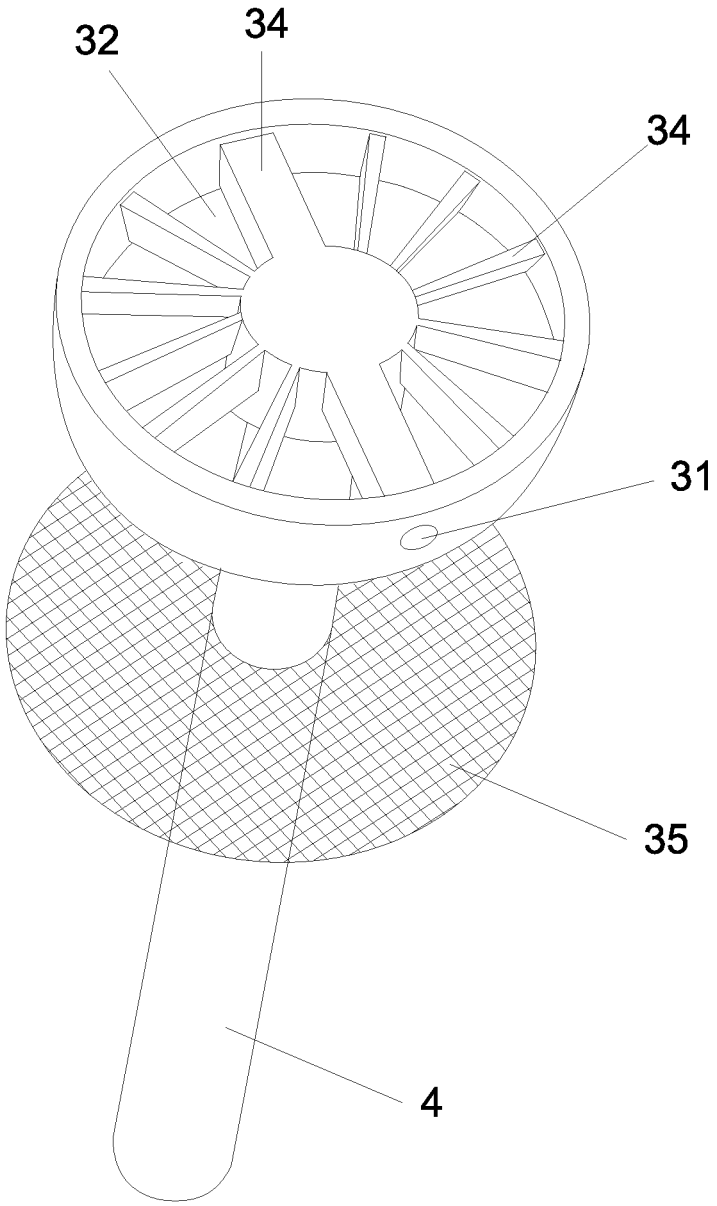
FIG. 4A is a schematic view showing the circular element provided with a filter according to one embodiment of the invention.
Figure 4B:
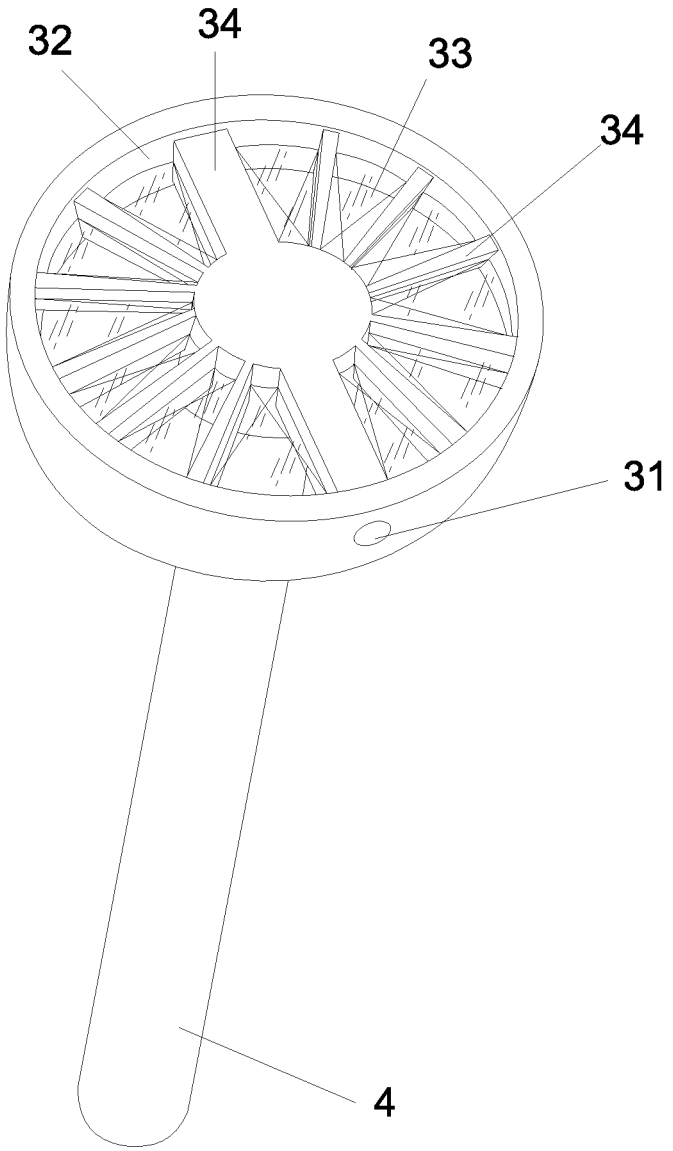
FIG. 4B is a schematic view showing the circular element provided with one-way valves on the holes according to one embodiment of the invention.
Figure 4C:
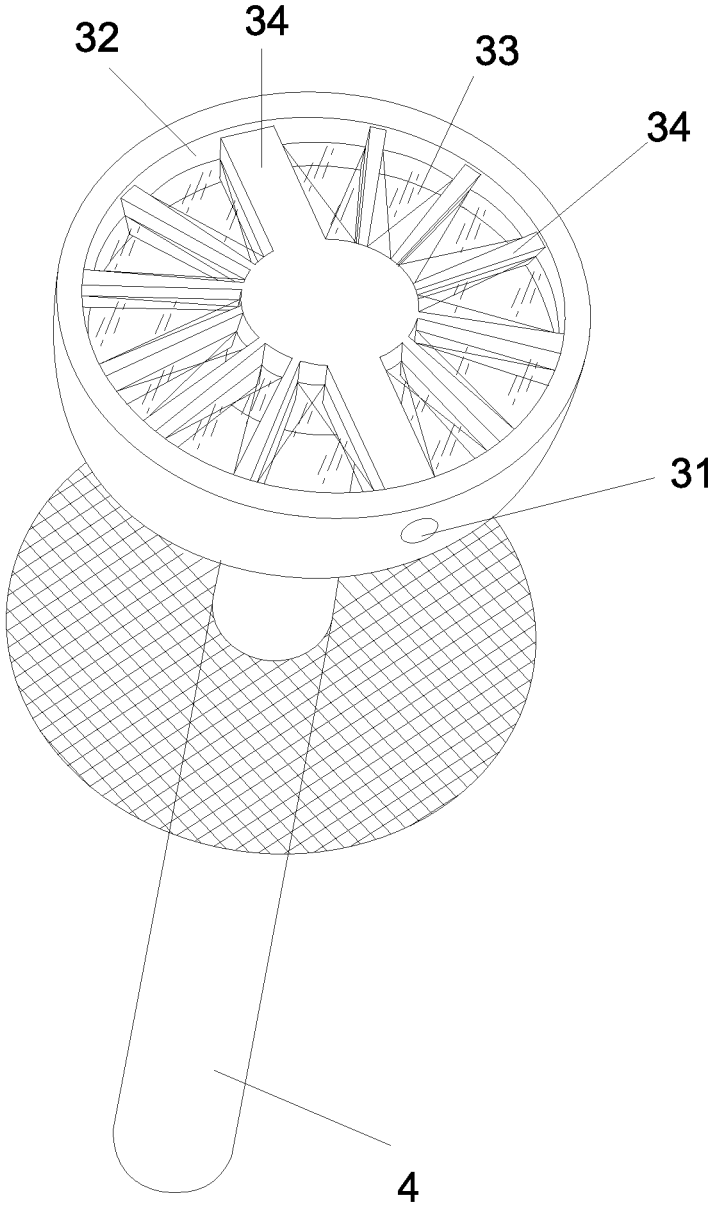
FIG. 4C is a schematic view showing the circular element provided with one-way valves on the holes and a filter according to one embodiment of the invention.
Figure 5:
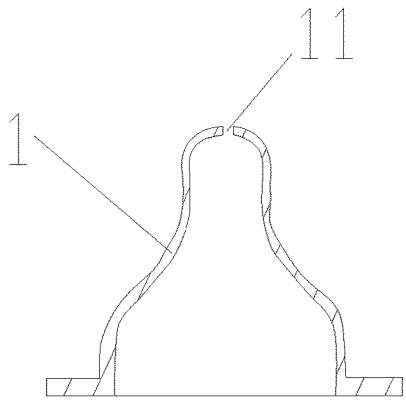
FIG. 5 is a schematic view of the nipple according to one embodiment of the invention, where the central bulge of the nipple is a milk hole.
Figure 6:
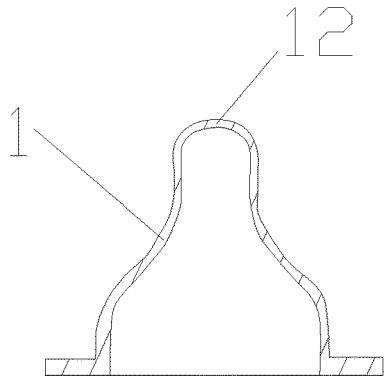
FIG. 6 is a schematic view of the nipple according to one embodiment of the invention, where the central bulge of the nipple is a nipple incision.

In one preferred embodiment, as shown in FIGS. 4A-4C, one form of nipple 1 can be set as following: milk hole 11 is located at a central bulge of the mouth of nipple 1. Another form of nipple 1 can be set as following: a nipple incision is located on a central bulge of the mouth of nipple 1.

The First Embodiment

Referring to FIG. 1, a nursing bottle having air returning function, comprising: bottle body 5, fixing cover 2, nipple 1, ventilation component, air conduit 4, elastic one-way valve 7 and mounting part 6, The ventilation component is circular element 3. The holes 32 are set on circular element 3 for delivering milk. The connecting way between air conduit 4, elastic one-way valve 7 and mounting part 6 is described as above. A milk hole 11 is located at a central bulge of the mouth of nipple 1.

First opening 41 of air conduit 4 is connected to air passage 31 of circular element 3. The air in the exterior of bottle body 5 passes through air passage 31, air conduit 4, and elastic one-way valve 7 to exchange with the interior air of bottle body 5, forming an air returning passage between the interior and the exterior of the bottle. When the nipple 1 is under a sucking condition, due to a pressure change, cut 71 on elastic one-way valve 7 slightly opens (cut 71 on elastic one-way valve 7 is in a close condition when there is no external force applied on it). The inner pressure and the external pressure of bottle body 5 are almost the same. The milk inside bottle body 5 flows into nipple 1 through holes 32. Obviously, in this embodiment, milk inside bottle body 5 can only flow out when nipple 1 is being sucked. There will be no air bubble generated in the milk, preventing the phenomenon of spitting up milk, choking and flatulence of the infant. At the same time, the number of nursing accessories are greatly reduced. The accessories of the present invention are easy to be taken apart and easy for installation, which brings in convenience for daily use, cleaning, sterilization and carrying. Since elastic one-way valve 7, air conduit 4, and mounting part 6 are connected to one another in a fixed manner or they are molded as a single piece without a joint, the user cannot separate these three parts during the use, which avoids the baby from accidentally eating the small-sized part. Further, this design can offset the gravity of the milk and automatically cutoff the outflow of milk when there is no sucking. Since the elastic one-way valve closes when there is no sucking, the milk will not enter and block the air conduit, so no frequent cleaning is required, and the normal outflow of the milk when the baby is sucking will not be affected. Further, since the milk will not flow into the air conduit, there is no need to use special tool to clean the interior of the air conduit, and the air conduit can be cleaned and sterilized under high temperature from the outside. When the baby starts to suck the nipple, the elastic one-way valve opens automatically to allow the air to flow into the bottle, so the milk can flow out smoothly. Further, with this design, no more venting hole is required on the nipple, so leakage of the milk due to damage to the venting hole on the nipple and nutrition loss will not happen. Moreover, the conventional nursing bottle with a venting hole on the nipple tends to block the venting path as the venting hole gets blocked easily, which will further cause collapse of the nipple. In this case, the baby is forced to open the mouth and thus inhale more air, thereby causing flatulence or abdominal distension. Also, with the air conduit, the one-way valve, and the mounting part molded as a single piece with a joint, the elastic one-way valve can be reduced to a very small size, so the elastic one-way valve will not become damaged easily during daily assembling, disassembling, washing, and cleaning, the production cost is reduced, and the structure is very simple. The one-way valve damaged during frequent washing and disassembling will make the one-way valve fail to open and close automatically when the baby sucks the nipple, so the milk will flow into and block the air conduit and the gravity of the liquid cannot be offset, and thus the milk cannot flow out smoothly and the baby is likely to suffer choking or suck air. Therefore, the manufacturing process is relatively simple, and thus mass production can be easily achieved.

The Second Embodiment

This embodiment differs from the first embodiment in that the central bulge of the mouth of nipple 1 mouth comprises nipple incision 12. When the bottle is inverted, the milk inside bottle body 5 will not flow through nipple 1. Only when the baby sucks nipple 1 and the cut on it opens, the milk inside the bottle body 5 flows out. All the rest of the components are the same as described in the first embodiment.

The Third Embodiment

This embodiment differs from the first embodiment in that: holes 32 on circular element 3 are each provided with a one-way valve 33. When the bottle is inverted, due to the one-way valves 33 setting on holes 32, when there is no external force applied on the nipple 1, the one-way valves 33 close, and the milk inside bottle body 5 will not flow to nipple 1 or even to the external of bottle body 5 through holes 32. Only when the baby sucks the nipple 1, the one-way valves 33 open, then the milk flows out from the bottle body 5 through holes 32. All the rest of the components are the same as described in the first embodiment.

The Fourth Embodiment

This embodiment differs from the first embodiment in that: the central bulge of the mouth of nipple 1 comprises nipple incision 12. Under the application of one-way valves 33 of holes 32, an additional anti-leakage component is set on nipple 1. When the bottle is inverted, the milk inside bottle body 5 will not flow to nipple 1. Only when the baby sucks nipple 1, cut 12 on nipple 1 opens, one-way valves 33 on holes 32 open, then the milk flows out from bottle body 5. All the rest of the components are the same as described in the third embodiment.

The Fifth Embodiment

Figure 7:
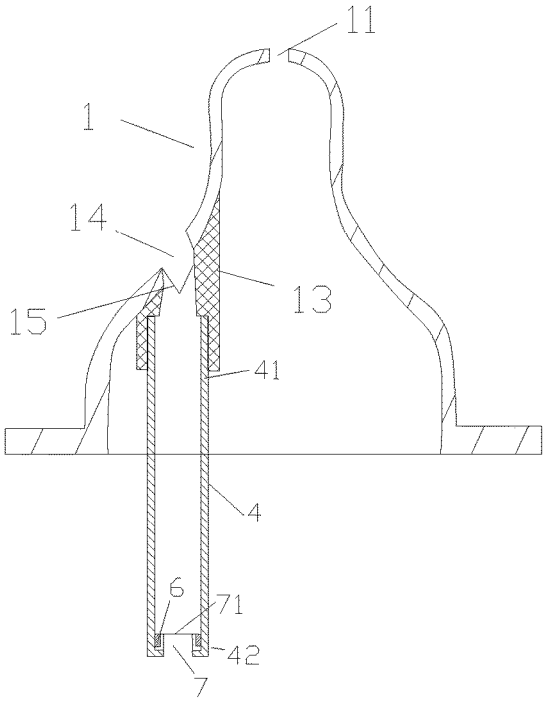
FIG. 7 is a connection diagram of another embodiment of the invention provided with a gas hole, the supporting component, the air conduit and the elastic one-way valve, the mounting part, where the central bulge of the nipple is a milk hole.
Figure 8:
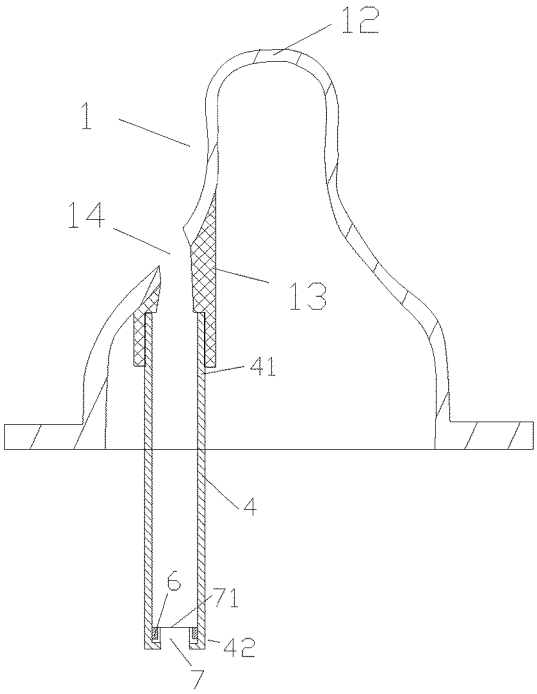
FIG. 8 is a connection diagram of another embodiment of the invention provided with a gas hole, the supporting component, the air conduit and the elastic one-way valve, the mounting part, where the central bulge of the nipple is a nipple incision.
Figure 9:
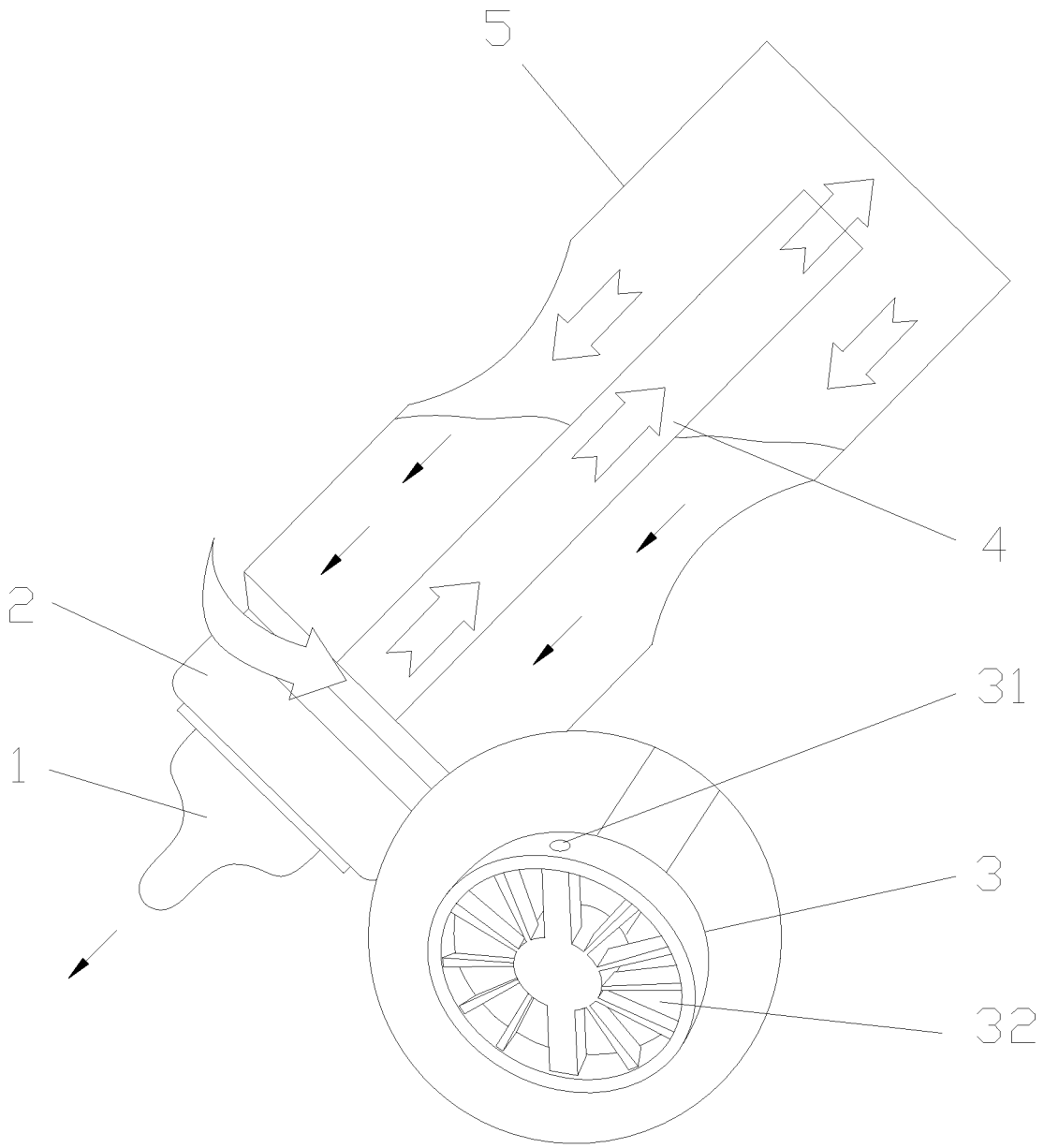
FIG. 9 is a schematic diagram showing the flow of the air and milk as indicated by the arrows (large arrows indicate the flow of air and small arrows indicate the flow of the liquid/milk).

Referring to FIGS. 7-8, this embodiment differs from the first embodiment in that the ventilation component is gas import hole 14, supporting component 13 is connected with gas import hole 14. The connecting way of air conduit 4, elastic one-way valve 7 and mounting part 6 is as described above.

First opening 41 of air conduit 4 is connected to the supporting component 13. The air in the inner ambiance orderly passes through elastic one-way valve 7, air conduit 4, supporting component 13, gas import hole 14 and bottle body 5 to exchange with the exterior air of bottle body 5. An air returning passage is formed between the inner ambiance and the exterior of the bottle. The working principle in this embodiment is the same as the first embodiment.

The Sixth Embodiment

Referring to FIG. 8, this embodiment differs from the fifth embodiment in that the central bulge of nipple 1 mouth comprises nipple incision 12. When the bottle is inverted, the milk inside bottle body 5 will not flow through nipple 1. Only when the baby sucks the nipple 1 and the nipple incision on it opens, the milk inside bottle body 5 flows out. All the rest of the components are the same as described in the fifth embodiment.

The Seventh Embodiment

Figure 10:
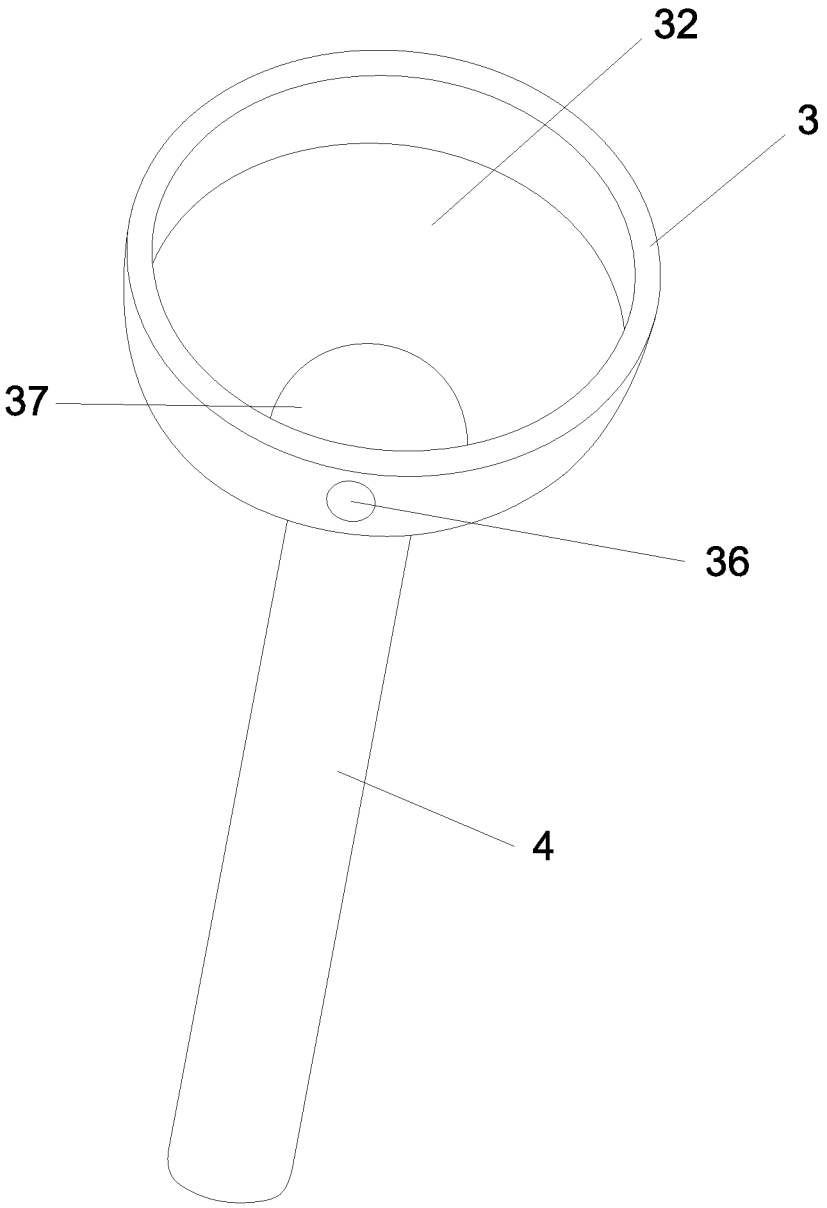
FIG. 10 is a schematic diagram showing another embodiment of the ventilation component and the air conduit of the invention.
Figure 11:
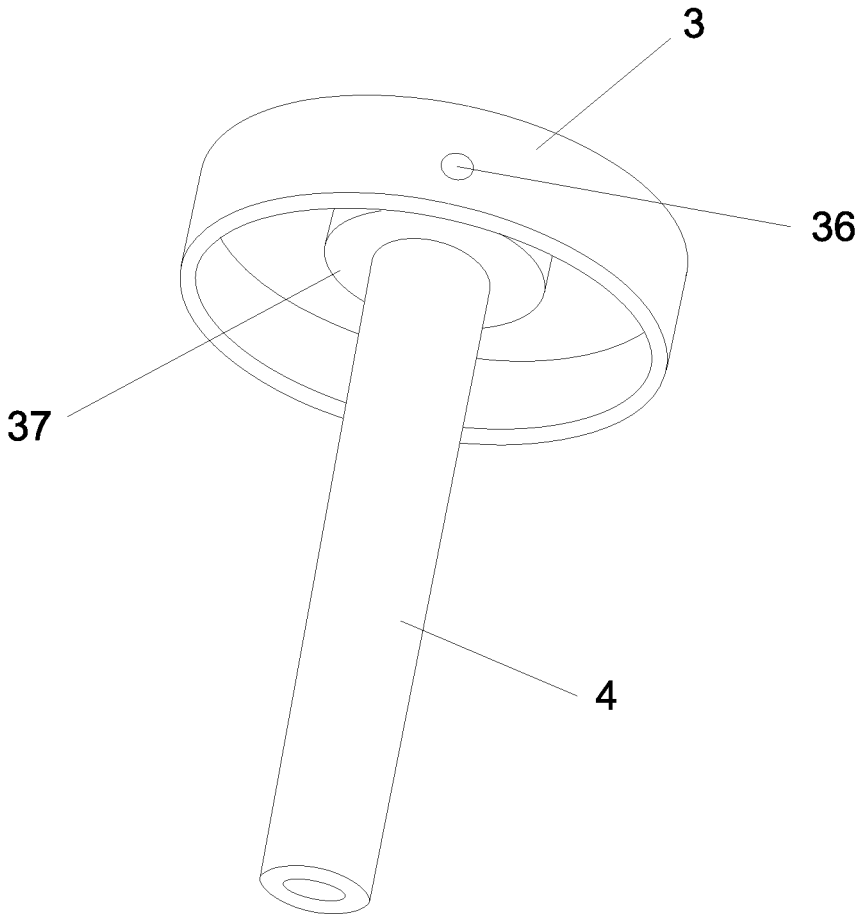
FIG. 11 is another perspective view of FIG. 10.

As shown in FIGS. 10-11, this embodiment differs from the first embodiment in that the ventilation component includes the circular element 3, the circular element 3 is provided with the air inlet 36 running through the sidewall of the circular element 3, and the exterior of the bottle communicates with the air conduit 4 via the air inlet 36.

When in use, the circular element 3 is mounted on the opening of the bottle, and the liquid inside the bottle flows out through the opening 31 of the circular element 3. The configuration of the air conduit 4 and the elastic one-way valve 7 is the same as the above embodiments. A fastening element 37 is fixed on the inner sidewall of the circular element 3 at the position of the air inlet 36. The fastening element 37 communicates with the air inlet 36 to allow air inflow. The air conduit 4 is connected to the fastening element 37 in an interference fit.

The first embodiment to the sixth embodiment can reduce the contacting area between the air and the milk, and this lowers the amount of loss of vitamin. The baby would not spit up milk due to sucking of air. The resistance for the flowing of the milk is reduced. The baby can suck milk without using too much strength. When the baby is not sucking, the milk inside the milk bottle is prevented from flowing out (decreasing the positive force to the lowest level when feeding). The milk flows out of the bottle only if the baby sucks the milk. The phenomenon of spitting up milk, choking and flatulence will be omitted since no air bubble is generated. The number of accessories for the bottle are greatly reduced, which brings in convenience for daily use, cleaning, sterilizing and carrying. The risk for the baby's swallowing of small accessories is reduced. The manufacturing process is relatively simple, the mass production is thus achieved. The air returning assembly of the present invention can be used in nursing bottles, but not limited thereto. It can also be used in other drinking containers which need the functions of air returning and conducting. The device can also be used in children's drinking cup, but not limited thereto.

While only several embodiments of the present invention have been shown and described, many changes and modifications may be made relative thereto without departing from the spirit and scope of the invention.

The invention claimed is:

1. A nursing bottle having air returning function, comprising: a bottle body, a fixing cover, a nipple, wherein one end of the bottle body opens and another end of the bottle body closes; the fixing cover is used to fasten the nipple with the bottle body; and the nursing bottle further comprises:

a ventilation component, wherein an interior of the bottle body exchanges air with an exterior of the bottle body through the ventilation component;

an air conduit, wherein the air conduit has two open ends for venting, and a first opening of the air conduit is connected with the ventilation component;

an elastic one-way valve set at a second opening of the air conduit and located in the interior of the air conduit, wherein the elastic one-way valve has at least one cut thereon; and a mounting part located on the second opening of the air conduit to secure the elastic one-way valve; wherein the ventilation component, the air conduit, the elastic one-way valve and the mounting part are separately manufactured and connected to one another in a fixed manner to form a gas returning device located in the interior of the bottle, and the nipple is provided with no hole for venting;

the ventilation component comprises a circular element having at least one bar passing through a center of the circular element and connecting two points on the circular element, the circular element is located at an opening of the bottle body; an air passage runs through the bar and a sidewall of the circular element at the two points along a length direction of the bar, and at least one hole is formed on the circular element by the bar for passing liquid;

the air passage is connected to the first opening of the air conduit, air from an exterior of the bottle body successively passes through the air passage, the air conduit, and the elastic one-way valve to exchange air with the interior of the bottle body, the liquid inside the bottle body flows to the nipple through the at least one hole formed on the circular element; and the at least one hole formed on the circular element is provided with a one-way valve, the one-way valve opens when an external force is applied on the nipple and closes when the nipple is in a normal status.

2. The nursing bottle having air returning function of claim 1, wherein the air conduit and the mounting part are made of a solid material or an elastic material with a high rigidity, and the elastic one-way valve is made of an elastic material.

3. The nursing bottle having air returning function of claim 1, wherein a back-up ring is located at the second opening of the air conduit; the back-up ring is used for the installation of the elastic one-way valve; the back-up ring and the air conduit are molded as a single piece without a joint.

4. The nursing bottle having air returning function of claim 3, wherein an edge of the back-up ring is connected between the back-up ring and the mounting part.

5. The nursing bottle having air returning function of claim 4, wherein the mounting part is used to fix the elastic one-way valve and keep the elastic one-way valve at a natural status.

6. The nursing bottle having air returning function of claim 1, wherein, the air passage has an interference fit with the first opening of the air conduit.

7. The nursing bottle having air returning function of claim 1, wherein a diameter of the circular element is no less than a diameter of the opening of the bottle body.

8. The nursing bottle having air returning function of claim 1, wherein a central bulge of a mouth of the nipple is set with a milk hole.

9. The nursing bottle having air returning function of claim 8, wherein the central bulge of the mouth of the nipple comprises a nipple incision.

10. The nursing bottle having air returning function of claim 1, the circular element is provided with a filter at the at least one hole.

11. A nursing bottle having air returning function, comprising: a bottle body, a fixing cover, a nipple, wherein one end of the bottle body opens and another end of the bottle body closes; the fixing cover is used to fasten the nipple with the bottle body; and the nursing bottle further comprises:

a ventilation component, wherein an interior of the bottle body exchanges air with an exterior of the bottle body through the ventilation component;

an air conduit, wherein the air conduit has two open ends for venting, and a first opening of the air conduit is connected with the ventilation component;

an elastic one-way valve set at a second opening of the air conduit and located in the interior of the air conduit, wherein the elastic one-way valve has at least one cut thereon; and a mounting part located on the second opening of the air conduit to secure the elastic one-way valve; wherein the ventilation component, the air conduit, the elastic one-way valve and the mounting part are molded as a single piece without a joint and form a gas returning device located in the interior of the bottle, and the nipple is provided with no hole for venting;

the ventilation component comprises a circular element having at least one bar passing through a center of the circular element and connecting two points on the circular element, the circular element is located at an opening of the bottle body; an air passage runs through the bar and a sidewall of the circular element at the two points along a length direction of the bar, and at least one hole is formed on the circular element by the bar for passing liquid;

the air passage is connected to the first opening of the air conduit, air from an exterior of the bottle body successively passes through the air passage, the air conduit, and the elastic one-way valve to exchange air with the interior of the bottle body, the liquid inside the bottle body flows to the nipple through the at least one hole formed on the circular element; and the at least one hole formed on the circular element is provided with a one-way valve, the one-way valve opens when an external force is applied on the nipple and closes when the nipple is in a normal status.

12. The nursing bottle having air returning function of claim 11, wherein a back-up ring is located at a second opening of the air conduit; the back-up ring is used for the installation of the elastic one-way valve; the back-up ring and the air conduit are molded as a single piece without a joint.

13. The nursing bottle having air returning function of claim 11, the circular element is provided with a filter at the at least one hole.

* * * * *